United States Patent [19]

Lamensdorf et al.

[11] Patent Number: 4,618,865

[45] Date of Patent: Oct. 21, 1986

[54] DIELECTRIC TROUGH WAVEGUIDE ANTENNA

[75] Inventors: David Lamensdorf; Chris J. Daigle, both of Middlesex County, Mass.

[73] Assignee: Sperry Corporation, New York, N.Y.

[21] Appl. No.: 654,716

[22] Filed: Sep. 27, 1984

[51] Int. Cl.[4] ..... H01Q 13/28

[52] U.S. Cl. ..... 343/776; 343/785

[58] Field of Search ..... 343/772, 776, 777, 785

[56] References Cited

U.S. PATENT DOCUMENTS

| | | | |
|---|---|---|---|
| 2,929,065 | 3/1960 | Kreinheder | 343/758 |
| 3,005,201 | 10/1961 | Rothman | 343/772 |
| 3,018,480 | 1/1962 | Thourel | 343/785 |
| 3,155,975 | 11/1964 | Chatelain | 343/785 |

*Primary Examiner*—Eli Lieberman

*Attorney, Agent, or Firm*—Howard P. Terry

[57] ABSTRACT

A dielectric trough waveguide antenna composed of a metallic guide having a dielectric substrate covering the bottom of the guide and a plurality metal radiators placed periodically on the dielectric at the dielectric-air interface provides a low loss antenna suitable for millimeter wave applications.

8 Claims, 7 Drawing Figures

DIELECTRIC TROUGH WAVEGUIDE ANTENNA

BACKGROUND OF THE INVENTION

1. Field of the Invention

This invention pertains to leaky wave antennas particularly dielectric trough waveguide antennas for use at millimeter wave frequencies.

2. Description of the Prior Art

The designs of most antennas that operate at millimeter wavelength frequencies have evolved from optical or quasi-optical concepts for focusing beams. These concepts have included parabolic reflectors, lenses and horns which are used to obtain a pencil beam. However, when they are used in a seeker radar or radiometer mounted in a missile, these designs have the limitations of relatively large volume and require mechanical movement to scan the beam. The depth and overall volume of optical type antennas can be reduced by using planar arrays. There are a large variety of planar arrays that have compact feed systems and thin overall depth. A survey of such arrays is given by P. S. Hall and J. R. James, in "Survey of Design Techniques for Flat Profile Microwave Antennas and Arrays", The Radio and Electronic Engineer, Vol. 48, No. 11, pp. 549–565, November 1978.

One type of planar array is a slotted waveguide composed of discrete radiators on a non-radiating transmission line. In addition to the slotted waveguide, a variety of leaky wave antennas with periodic radiators are well known in the art. There are dielectric image lines and dielectric waveguides with gratings composed of metal patches along the side to couple energy out of the waveguide to form a beam. Such antennas are described by T. Itoh, "Application of Gratings in a Dielectric Waveguide for Leaky-Wave Antennas and Band-Reject Filters", IEEE Transactions MTT-25, No. 12, December 1977, pp. 1134–1138.

K. L. Klohn et al, "Silicon Waveguide Frequency Scanning Linear Array Antenna", IEEE Transactions, MTT-26, No. 10, October, 1978, pp. 764–773.

K. Solbach, "E-Band Leaky Wave Antenna Using Dielectric Image Line with Etched Radiating Elements", IEEE, MTT International Microwave Symposium, Orlando, FL. 1979.

M. T. Birand et al, "A Printed Millimeter Wave Array Using a Low Loss Dielectric Waveguide Feeder", IEE-AP Conference, York, England, April 1981.

There is some reliable analytic evidence reported by,

S. T. Peng, and A. A. Oliner, "Radiation from Grating Antennas on Dielectric Waveguides of Finite Width", European Microwave Conference, Amsterdam, The Netherlands, September, 1981 pp. 757–762, that the grating described above can excite significant crosspolarization in the radiated field. A potentially more serious problem is the mutual coupling between the leaky wave elements in the planar array. Each of the leaky wave elements produce a fan beam with significant radiation that can couple into adjacent elements. There are other types of leaky wave antennas that might be considered for use in planar arrays including the metallic trough waveguide antenna and the sandwich wire antenna. The metallic trough waveguide antenna does not have a dielectric substrate which is advantageous to make the device compatible with integrated circuits. The sandwich wire antenna is more difficult to fabricant and has potentially higher loss because of the thin wire center conductor. Previous planar antennas all have certain undesirable features such as high ohmic loss, manufacturing difficulty, incompatibility with electronic steering, narrow operating bandwidth or limited frequency range. The present invention overcomes the above mentioned limitations at millimeter wave frequencies through the use of a dielectric trough waveguide antenna having a plurality of metallic radiators spaced periodically along the top surface of the dielectric. In the aperture of the antenna, the E-field goes to zero at the side wall. This constraint and the polarization minimize the coupling into the adjacent trough waveguide antenna.

SUMMARY OF THE INVENTION

The apparatus of the present invention includes a leaky wave dielectric trough guide antenna for use at high microwave and millimeter wave frequencies having a dielectric substrate of predetermined thickness covering the bottom of the trough guide and metallic strip radiators placed on the upper surface at periodic intervals. A termination composed of a wedge-shaped absorber is placed at one end of the trough guide. A planar array may be fabricated by placing a plurality of trough waveguide antennas adjacent to each other and coupling electromagnetic energy to the antenna through an appropriate feed system.

DESCRIPTION OF THE PREFERRED EMBODIMENT

Figure 1A:
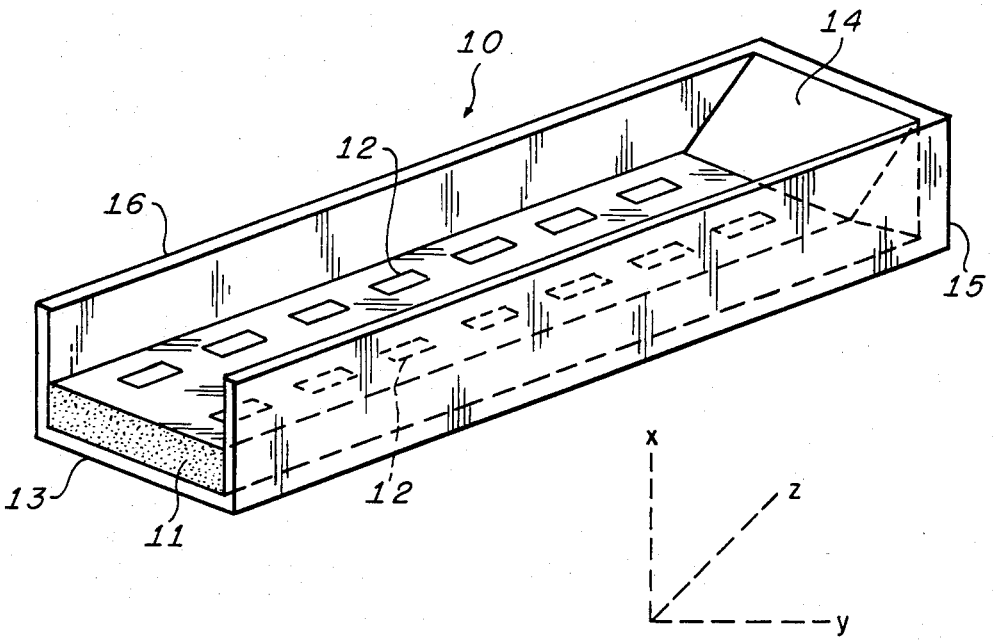
FIG. 1*a* is a perspective view of the dielectric trough waveguide with metallic radiator on the surface of the substrate.
Figure 1B:
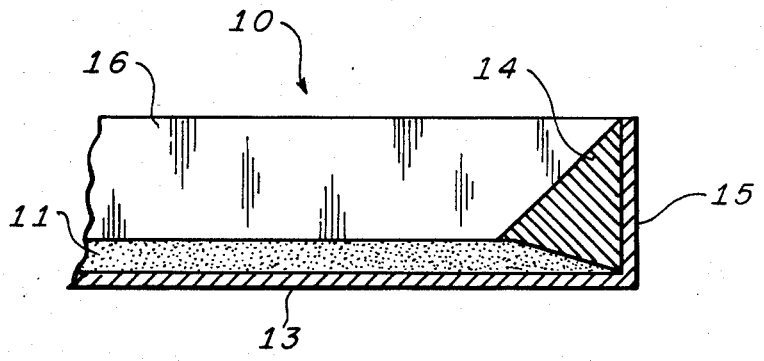
FIG. 1*b* is a side view of the dielectric trough waveguide showing the load termination.

A diagram of the dielectric trough waveguide antenna 10 is shown in FIG. 1*a*. A dielectric substrate 11 with metallic radiators 12 on its surface, each to be described subsequently, is placed on the bottom 13 of the trough waveguide antenna 10. A matched load termination 14, cut in the form of a wedge, is placed at one end 15 of the guide 10 toward which the dielectric substrate 11 has been tapered as shown in FIG. 1*b*. The termination may be made from an absorbing material such as Advanced Absorber Products-LS.

Figure 2:
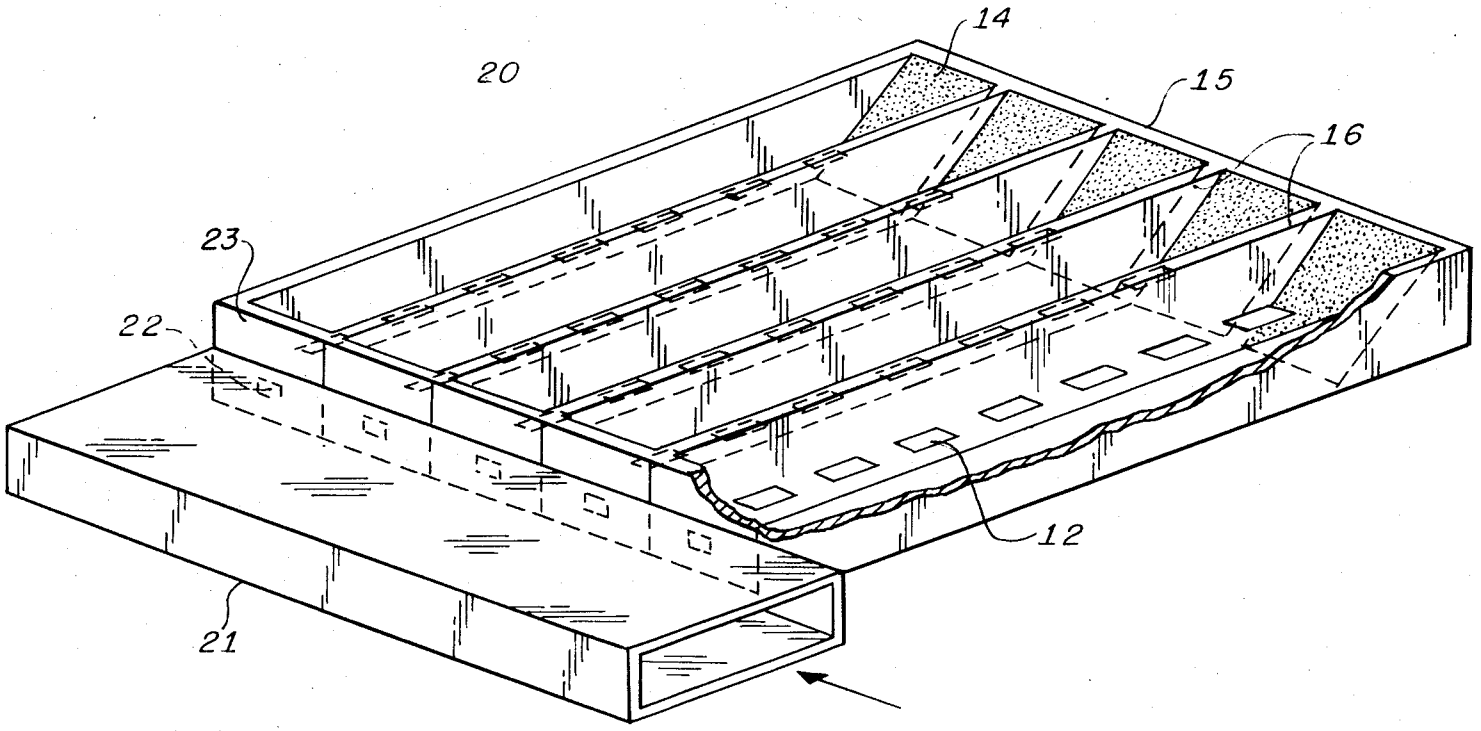
FIG. 2 is a planar array of dielectric trough waveguide antennas with a series waveguide feed.

Referring now to FIG. 2, various types of transitions may be used between the dielectric trough guide antenna 10 and a rectangular waveguide. For example, one or more slots or holes 22 in one end wall 23 of the trough guide 10 may couple energy from the feed to the trough waveguide. This is a frequency sensititive method but would eventually be the most useful for an array 20 as shown in FIG. 2.

Figure 3B:
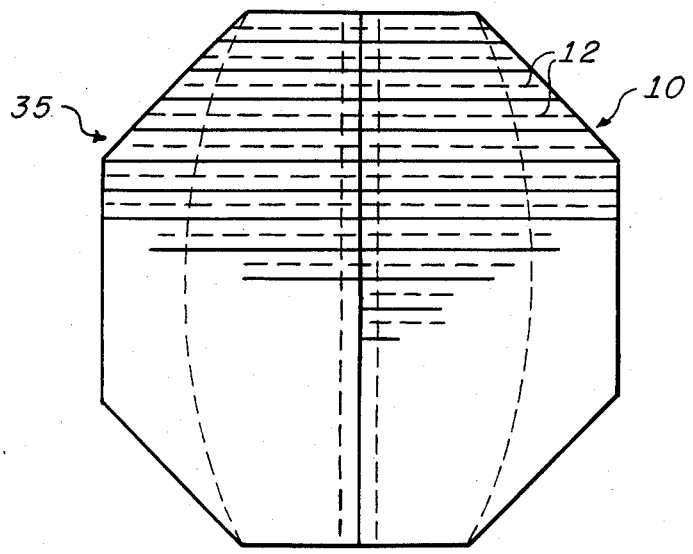
FIG. 3 is a flat plate array of dielectric trough waveguide antenna using a pillbox feed.
Figure 3A:
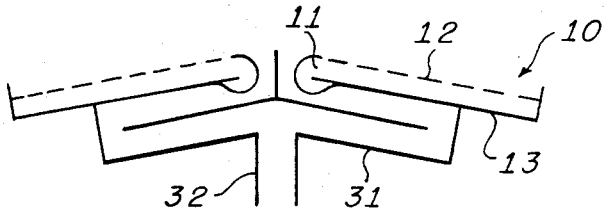

A gradual or tapered transition is less frequency sensititve but, in general, requires more space. The dielectric trough guide antenna 10 may be combined with the well known pillbox feed system 31 as illustrated in FIG. 3*a* to provide a compact transition from waveguide 32 to dielectric trough guide antenna 10. The dielectric substrate 11 is folded beneath the bottom 13 of trough guide 10 to provide the transition. The compact feed system illustrated in FIG. 3*a* may be used in the fabrication and fan array 35 of dielectric trough waveguide antennas 10.

The open transmission line upon which this antenna is based is a surface waveguide with low loss and comparatively large cross-sectional dimensions. These properties make it very useful at millimeter wave frequencies where components become small and ohmic loss can become significant. The line has been comprehensively analyzed in:

"Millimeter and Submillimeter Waves", edited by F. A. Benson, Iliffe Books Ltd. London 1969, Chpt. 17, Surface Wave Transmission Lines, M. Cohn, p.289.

Referring again to FIG. 1*a*, the fields in the dielectric trough waveguide 10 for the dominant mode have $E_X$, $E_Y$, $E_Z$, $H_Y$, $H_Z$ components.

The dominant mode of the dielectric trough guide is $TM_{11}$. The normalized components of the fields in the dielectric ($0<x<a$) are given as follows:

$$E_x = j\frac{\beta^2 b^2 + \pi^2}{\omega\epsilon\pi b}\cos k_d \times \sin\frac{\pi}{b}y \quad (1)$$

$$E_y = -j\frac{k_d}{\omega\epsilon}\sin k_d \times \cos\frac{\pi}{b}y \quad (2)$$

$$E_z = -\frac{k_d\beta_b}{\omega\epsilon\pi}\sin k_d \times \sin\frac{\pi}{b}y \quad (3)$$

$$H_y = j\frac{\beta b}{\pi}\cos k_d \times \sin\frac{\pi}{b}y \quad (4)$$

$$H_z = \cos k_d \times \cos\frac{\pi}{b}y \quad (5)$$

in the air above the dielectric ($x>a$), the fields can be expressed by modifying the above, with $\epsilon=\epsilon_o$, $x=a$, and each equation multiplied by $e^{Ka(a-x)}$. In the above equations, $\beta$ is the guide wave number and $k_d$ and $k_a$ *are the transverse wave numbers in the dielectric and air, respectively.*

The field at air-substrate interface will now be described. From the tangential components of the E-field at the dielectric-air interface, the coupling between the guide 10 and small metal strips 11 on the interface 12, can be estimated. For the $TM_{11}$ mode, the z component of the E-field is maximum at the center of the guide and goes to zero at the side walls. Therefore, a metal strip 11 placed on the surface of the dielectric substrate will have the maximum excitation or coupling to the guide when placed at the center of the guide. The polarization of the field coupled out of the guide will be parallel to the wire or z dimension. It will propagate normal to the guide with two side walls acting as a parallel plate region. The configuration of the field coupled out is the $TE_{01}$ mode with the E-field parallel to the side walls. This happens because $E_{X=o}$ along the metallic strips 11, supressing the $TM_{11}$ causing a transition to $TE_{01}$ above the dielectric. The y component of the E-field has odd symmetry about the axis of the guide for the $TM_{11}$ mode. Therefore, a metal strip 11 or pair of strips placed symmetrically with respect to the axis will not couple any energy out of the guide with x or cross-polarization.

The thickness of the dielectric substrate 11 was chosen so the $E_z$ is maximum at the interface. This maximizes the interaction between the guide fields and the radiator. Therefore, $E_Z$ was derived as a function of the power $P_Z$ going down the trough guide and the dimensional parameters of the guide. The power travelling in the z direction along the guide having a dielectric thickness "a", is the following:

$$P_z = \frac{\beta b\left(\beta^2 + \left(\frac{\pi}{b}\right)^2\right)}{8\left(\frac{\pi}{b}\right)^2 \Omega\epsilon k_d}\left\{k_d a + \sin k_d a \cos k_d a + \left(\frac{\epsilon}{\epsilon_o}\right)^2 \frac{\cos^3 k_d a}{\sin k_d a}\right\} \quad (6)$$

The expressions for the components of the field, $E_X$ and $H_y$, are taken from equations 1 and 4. The first two terms in the bracket are proportional to $P_Z$ in the dielectric substrate and the last term in the bracket is proportional to $P_Z$ in air. By equating the normalizations of $E_Z^2$ obtain from eq.3 and $P_Z$ in eq.6, $E_Z$ is obtained as a function of $P_Z$, and the properties of the dielectric (e and a).

$$E_z = \frac{P_z 2(2\beta k_d^2)^{\frac{1}{2}}\sin k_d a}{(\omega\epsilon b)^{\frac{1}{2}}\left[\beta^2 + \left(\frac{\pi}{b}\right)^2\right]^{\frac{1}{2}}\left\{k_d a + \sin k_d a \cos k_d a + \left(\frac{\epsilon}{\epsilon_o}\right)^2 \frac{\cos^3 k_d a}{\sin k_d a}\right\}^{\frac{1}{2}}} \quad (7)$$

Various factors are to be considered in choosing the dielectric substrate material including the dielectric constant, dielectric loss, temperature stability, homogeneity, size availability, and cost. A high dielectric constant reduces the cross-sectional dimensions of the guide, especially the dielectric thickness and tightens the dimensional tolerance required. Dielectric loss is the most significant loss for this line and is directly determined by the choice of a substrate. Many dielectric materials have dimensions and electrical parameters that are sensitive to with temperature and this must be considered in any final design using this type of guide. The materials are also often composed of substrate filled with another material such as PTFE (teflon) filled with glass microfiber. This can be inhomogeneous and/or anistropic, especially at millimeter wave frequencies. The thickness for which many dielectric materials are available is limited, especially for larger thicknesses needed for microwave frequency applications.

Examples of substrate materials include Duroid 5880 (Rogers), Cuclad K-6098 (3M), Diclad (Keene), irradiated polyolefin (Electronized Chemical Corp.) and Teflon (Polyflon). The first three are essentially glass fiber filled Teflon and therefore stable. They have wide application as substrate material at microwave frequencies and for the first two, through millimeter wave frequencies. However, because of the filling, they can have anisotropic and/or inhomogeneous properties that may be a problem at millimeter wave frequencies. Also, they are not readily available at thicknesses greater than 0.25 inches. The last two substrates were unloaded and therefore isotropic, homogeneous and low loss materials. However, their dimensional stability is not as good as the preceeding group. Other, higher dielectric constant substrates could also include, for example, quartz, alumina, or even gallium arsenide.

The design of the radiators in the present invention will now be discussed. Teflon was used as the preferred substrate material since it has low loss and can be easily obtained in various thicknesses and sizes with copper deposited on the sides. Substrate rods of rectangular cross-sections with copper on the surface form the basis of the troughguide. To form an array such as FIGS. 2 and 3, radiators may be etched from the top surface and metal side walls attached to the two narrower side walls using low temperature, solder paste.

Figure 4:
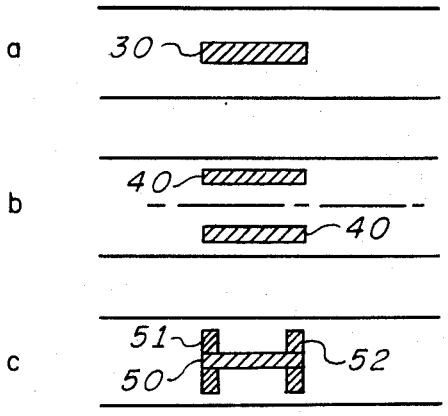
FIG. 4*a* is a single strip radiator along the centerline of the trough waveguide antenna.
FIG. 4*b* is a double strip radiator placed symmetrically about the centerline.
FIG. 4*c* is a tuned strip radiator.

Referring now to FIGS. 4*a*, 4*b* and 4*c*, the metal radiator may be, for example, a rectangular strip 30, two rectangular strips 40 or a rectangular strip with 50 end strips 51, 52 that may act as tuning stubs on the air-substrate interface. From Eqs. 2 and 3, it can be seen that $E_y$ is asymmetric with respect to the center line of the trough guide and $E_Z$ is symmetric. Therefore, a patch placed symmetric with the center line only perturbs $E_Z$, as desired. Since the $E_Z$ component of the field is equivalent to a z component of displacement current, interrupting $E_Z$ with a patch is equivalent to placing a series impedance in the line. Therefore, the radiator may ideally be represented by a series impedance which can be related to the energy coupled from the guide to the radiated field. Referring again to FIG. 1, radiators are placed substantially a guide wavelength apart on the surface of the dielectric substrate 11 and are parallel to the axis of the trough waveguide 10. The radiated field is polarized parallel to the axis. The separation between radiators 12 and the polarization of the radiated field reduces the mutual coupling between radiators on a leaky guide and also between adjacent guides in planar array 20.

After the radiators have been characterized for a particular trough guide by its series impedance, the leaky wave antenna can be designed using the techniques described in:

C. H. Walters "Traveling Wave Antennas", Chapter 4 McGraw Hill Book Company

Figure 5:
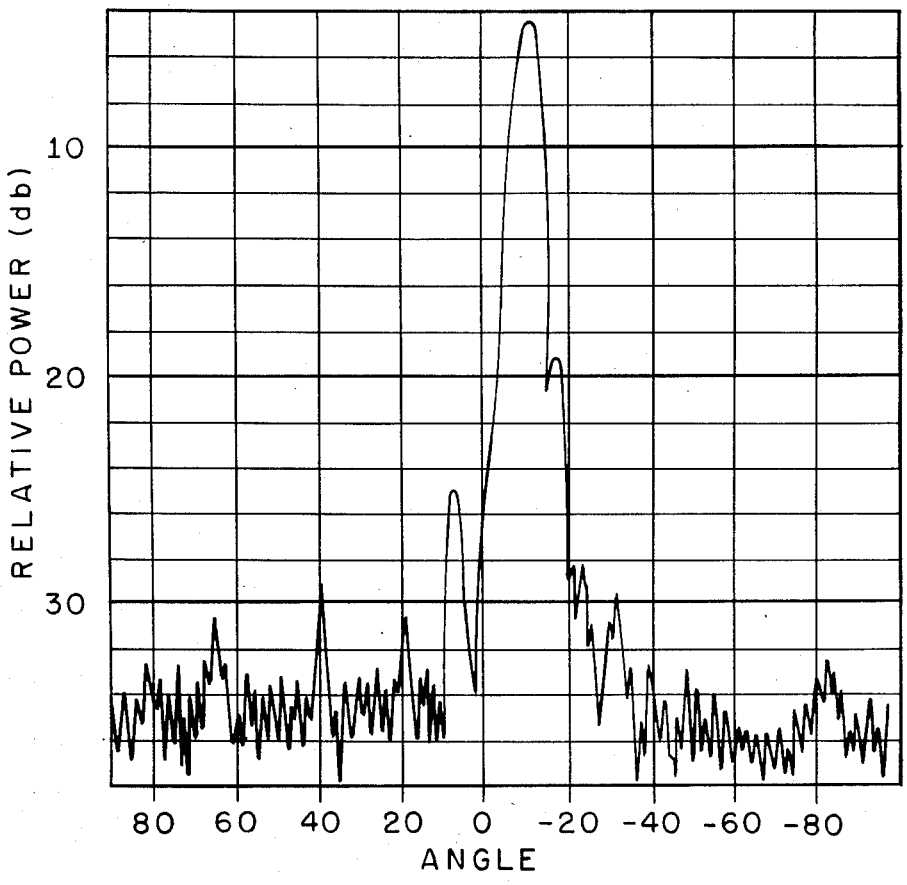
FIG. 5 is a measured radiation pattern for a dielectric trough waveguide antenna constructed in accordance with the principles of the invention.

Each radiator couples energy out of the guide by amount proportional to is resistance. Distribution can then be obtained for the leaky wave antenna from a series impedance perturbation of the propogation constant of the trough guide. The radiators or perturbations are uniformly spaced, with the spacing determining the direction of the beam of radiation. Boresight radiation cannot be achieved with this type of antenna because the spacing between radiators that is required will produce a high input missmatch to the antenna. An example of the measured performance with this type of antenna at x band (9.2–9.6 GHz) is shown in FIG. 5. However, although tested at x band frequencies, this type of antenna can be used from microwave through millemeter wave frequencies (1–100 GHz) with appropriate scaling.

While the invention has been described in its preferred embodiments, it is to be understood that the words which have been used are words of description rather than of limitation and that changes may be made within the purview of the appended claims without departing from the true scope and spirit of the invention in its broader aspects.

We claim:

1. A dielectric trough waveguide antenna comprising:

a metal trough waveguide having first and second ends, a solid rectangular bottom, and two parallel solid rectangular walls of preselected height electrically coupled to edges of said solid rectrangular bottom ;

a dielectric slab dimensioned to entirely cover said solid rectangular bottom between said parallel solid rectangular walls and having a thickness that is less than said preselected height positioned in said metal trough waveguide to form dielectric-waveguide bottom and dielectric-air interfaces;

a plurality of metallic radiating elements of predetermined dimensions, positioned on said dielectric at said dielectric-air interface with presselected spacings herebetween;

a termination at said first end of said metal trough waveguide; and waveguide feed means at said second end for coupling electromagnetic energy into said metal trough waveguide.

2. A dielectric trough waveguide antenna as recited in claim 1 wherein said dielectric comprises Teflon.

3. A dielectric trough waveguide antenna as recited in claim 1 wherein said termination comprises a wedge shaped electromagnetic radiation absorbing material.

4. A dielectric trough waveguide antenna as recited in claim 1 wherein said metallic radiating elements comprise a plurality of rectangular strips having short and long dimensions placed at periodic intervals along a centered longitudinal axis of said trough waveguide with said long dimension positioned parallel to said longitudinal axis.

5. A dielectric trough waveguide antenna as recited in claim 1 wherein said metallic radiating elements comprise a plurality of rectangular strips having short and long dimensions placed symmetrically about a centered longitudinal axis of said trough waveguide with said long dimension of said strip positioned parallel to said longitudinal axis.

6. A dielectric trough waveguide antenna as recited in claim 1 wherein said metallic radiating elements comprise a plurality of first metallic strips each having first and second ends and second metallic strips electrically coupled at each first and second ends, each first metallic strips having short and long dimensions, said long dimensions being positioned parallel to a longitudinal axis of said antenna.

7. A planar array of dielectric trough waveguide antennas comprising:

a multiplicity of trough waveguides each having first and second ends, a solid metallic rectangular bottom, and two parallel solid metallic rectangular walls of preselected height electrically coupled to edges of said rectangular bottom said trough waveguide positioned such that adjacent trough waveguides share a common solid metallic rectangular wall;

a dielectric slab dimensioned to entirely cover said solid rectangular bottom between said parallel solid rectangular walls and having a thickness that is less than said preselected height positioned in said waveguide to form dielectric-waveguide bottom and dielectric-air interfaces;

a plurality of metallic radiating elements of predetermined dimensions positioned on said dielectric at said dielectric-air interface with preselected spacings herebetween;

a termination of said first end of each of said trough waveguides; and a waveguide feed means at said second end of each of said trough waveguides for coupling electromagnetic energy into said trough waveguides.

8. A planar array antenna as recited in claim 7 wherein said waveguide feed means includes a waveguide sequentially coupled to said second ends of said trough waveguides.

* * * * *